US005678776A

United States Patent [19]

Zoz

[11] Patent Number: 5,678,776

[45] Date of Patent: Oct. 21, 1997

[54] APPARATUS FOR CHARGING AND EMPTYING A RECEPTACLE, ESPECIALLY A MILLING MACHINE OPERATING DISCONTINUOUSLY WITH DISCRETE MILLING BODIES

[75] Inventor: Henning Zoz, Feudenberg, Germany

[73] Assignee: ZOZ Maschinenbau GmbH, Kreuztal, Germany

[21] Appl. No.: 599,894

[22] Filed: Feb. 12, 1996

[30] Foreign Application Priority Data

Feb. 11, 1995 [DE] Germany ..... 195 04 540.8

[51] Int. Cl.[6] ..... B02C 17/18

[52] U.S. Cl. ..... 241/171; 241/172

[58] Field of Search ..... 251/315.01, 315.16; 241/171, 172, 81

[56] References Cited

U.S. PATENT DOCUMENTS 3,401,893 9/1968 Reynolds ..... 241/171

FOREIGN PATENT DOCUMENTS 43 07 083 9/1994 Germany .

*Primary Examiner*—Mark Rosenbaum
*Attorney, Agent, or Firm*—Herbert Dubno

[57] ABSTRACT

A mill, especially an intermittently operating mill with milling bodies is emptied or filled through an opening provided with a pair of ball cocks of which a ball proximal to the opening is integrated with a sieve plate in its through-going bore, thereby eliminating dead zones and contamination resulting from wear of the sieve.

14 Claims, 5 Drawing Sheets

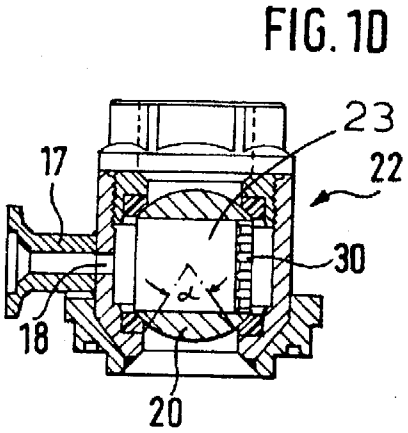
FIG. 1D
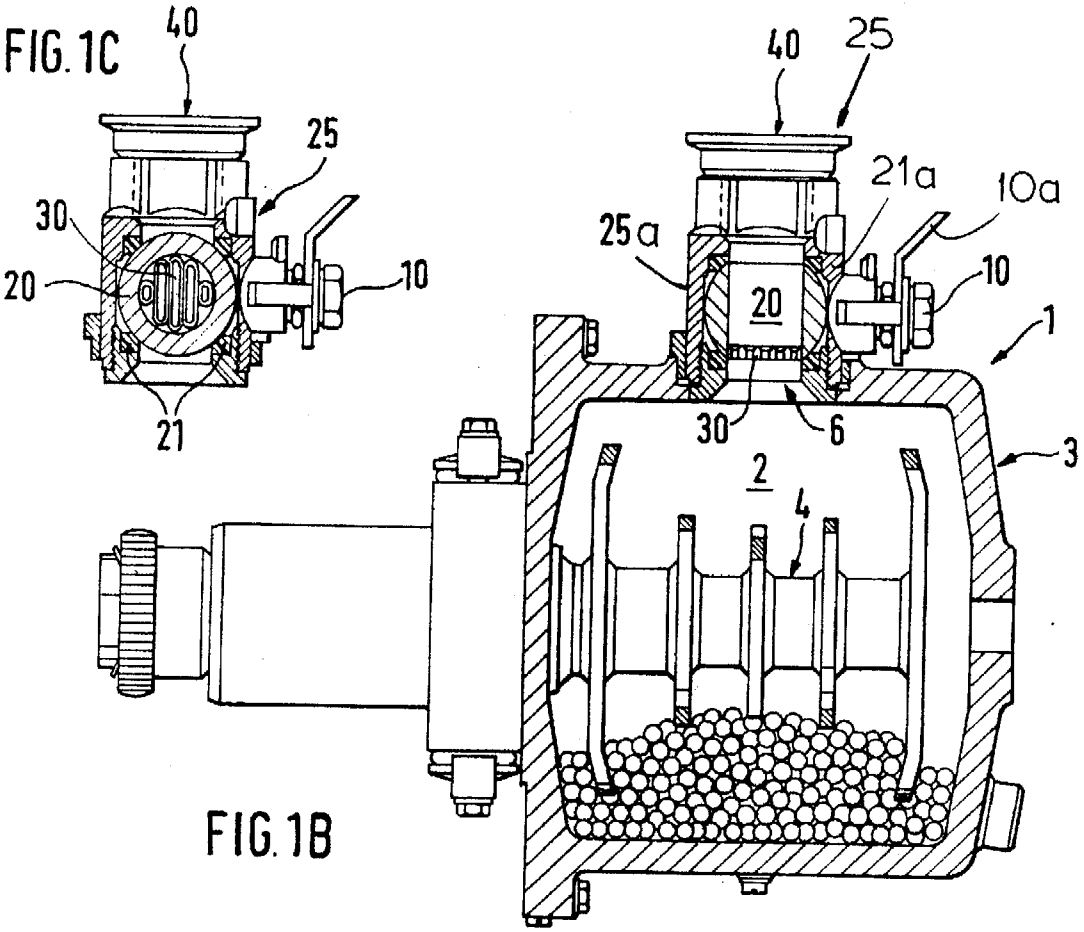
FIG. 1B
FIG. 1C 1
2
3
4
5
6
7
10
11
12
16
20a
20b
21a
21b
22
24
30
40
60
61

APPARATUS FOR CHARGING AND EMPTYING A RECEPTACLE, ESPECIALLY A MILLING MACHINE OPERATING DISCONTINUOUSLY WITH DISCRETE MILLING BODIES

FIELD OF THE INVENTION

My present invention relates to an apparatus for the charging and emptying of a receptacle, especially the housing of a mill operated with particulate milling bodies and as used for the finest milling of solids in a discontinuous process. In particular, the invention relates to an apparatus for charging or emptying a mill vessel in which the milling machine is an attritor, a drum mill, an oscillatory mill or the like in which milling bodies are agitated to comminute the material to be milled.

BACKGROUND OF THE INVENTION

In mills of the aforedescribed type, the vessel containing the milling bodies generally is provided with an opening for charging the vessels with the material to be comminuted and for discharging same from the vessel after comminution. Within the vessel, the machine can be provided with arms, paddles or the like for agitating the milling bodies in contact with the material to be milled so as to comminute the milled material and convert it into the finest of powders. The milling bodies and the milled material, as a result of the agitation, can be considered an energy-rich mass flow.

The milling aggregate is charged into the vessel or discharged therefrom under high vacuum or ultrahigh vacuum and/or under a controlled atmosphere, for example, an inert gas, via a variety of different devices in prior art systems. For example it is known to provide a closure for the inlet and outlet opening in the form of a mill cover which completely seals the milling chamber and has a geometric optimum with respect to kinetic energy transfers in the vessel and the flow conditions in the mass flow of the milling bodies product to be milled therein.

These optima, however, are seldom obtained because the mill cover must be removed for emptying the milling chamber and replaced by an emptying fitting which has a sieve plate or the like to allow discharge of the milled product while retaining the milling bodies within the vessel. With this system it is impossible to prevent contact between pulverulent milled product and the ambient atmosphere and reaction between them. The mills described are thus limited in utility since, with extremely fine milling, the surface areas of the products milled are so increased that the kinetics of the reaction between the product and ambient oxygen may destroy the product or render it useless. Hence limitations are established on the milling effectiveness by the manner in which the mill is charged and discharged where there is a danger of such interaction between the milled product and the ambient atmosphere.

Another apparatus which has been used for charging or discharging a discontinuously operating milling unit utilizing milling bodies has a fitting which remains on the vessel and has an extension from the inlet and outlet opening which directly adjoining this opening is formed with a sieve plate and at a location spaced from the opening is provided with a ball cock for closing off the fitting and thus preventing access of ambient air to the contents of the mill.

This system has the drawback that the extension provides a dead space with a certain volume in which the high energy mass flow of the mill bodies is not effective so that any product caught in this dead space is not finely comminuted and product discharged may be contaminated with noncomminuted product.

The presence of the sieve at the inlet or opening, however, is found not to be a significant problem although it does have a slight effect on the kinetics of the mass flow in the region thereof. The components in the sieve plate, however, provide edges and surfaces which are highly sensitive to wear and frequently material eroded from the sieve plate will contaminate the milled product. Furthermore, the wear of the sieve plate will require frequent replacement.

Of course a certain amount of contamination from the materials of which the apparatus is constructed cannot be avoided. However, for the milling of inert magnetic materials which are of an oxidic base and for which a nanostructure phase distribution is of critical importance, it is desirable to construct the mill of wear-resistant materials, such as carbides or nitrides of the type used in cutting tools, or to provide self-lubricating materials. In these cases even limited contamination from the sieve plate may pose a problem, especially since many of the finest powders which are produced from the new magnetic materials have a value of $1,000 per gram or more.

OBJECTS OF THE INVENTION

It is, therefore, the principal object of the present invention to provide an improved milling apparatus whereby the aforedescribed drawbacks are avoided and, especially, whereby the milling vessel can be charged and discharged with a minimum of product contamination whether by materials eroded from the sieve plate or by materials remaining in dead spaces of the charging units.

Another object of this invention is to provide an apparatus of the type described which minimizes loss of material or reduction in quality of finely comminuted milled products and also reduces wear of the apparatus significantly.

Another object of the invention is to provide an improved device for the charging and discharging of a milling apparatus of the type described whereby dead spaces are avoided, unnecessary contact of ambient air with the milled product is precluded and wear of sieve plates and the like is minimized.

SUMMARY OF THE INVENTION

These objects and others which will become apparent hereinafter are attained, in accordance with the invention, in a milling apparatus comprising:

a milling vessel formed with an opening for charging and discharging the vessel;

means in the vessel for agitating milling bodies in contact with a product to be milled for finely comminuting the product; and a device for charging and emptying the vessel, the device comprising:

a housing formed with a passage communicating with the opening, means for fluid-tight sealing of the housing to the vessel around the opening, a ball cock in the passage for controlling flow through the passage, the ball cock having a rotatable ball formed with a throughgoing bore, and at least one sieve plate in the bore disposed at an end thereof closest to the opening upon rotation of the ball to align the bore with the opening, the sieve plate being dimenioned to pass the product and retain the milling bodies in the vessel.

In particular, the device for charging or emptying the vessel comprises a valve structure with a fluid or medium-tight connection to the vessel at the inlet and outlet opening thereof, and at least one ball cock which in its bore through the valve ball at an end thereof closest to the inlet and outlet opening has at least one sieve plate.

According to a feature of the invention upon rotation of the ball to block the passage, the ball presents a blocking surface to the opening, the sieve plate intercepting substantially the same solid angle of the ball as the blocking surface.

The sieve plate and the blocking surface can thus be said to have the same radians.

According to another feature of the invention, along the passage, a first ball cock is provided proximal to the inlet and outlet opening of the vessel and is formed with the aforementioned sieve plate while spaced further along the passage, a second ball cock is provided for maintaining a vacuum in the vessel.

The housing can be connected by a flange formed with a groove receiving an O-ring to the vessel around the opening. The flange can have bores for clamping bolts. The ball cocks themselves can be of different constructions, since the ball cock proximal to the inlet and outlet opening of the vessel serves to mechanically close off the latter while the ball cock more distal therefrom serves to maintain the vacuum. For the mechanical closure, the seal between the ball and the housing may be provided with some play. The sealing rings engageable with the balls for the two cocks or the balls themselves may be composed of different materials based upon the different stresses applied thereto and the different functions of the ball cocks.

The ball cock closest to the inlet and outlet opening can be provided of comparatively yieldable elastic material, for example, an elastomeric synthetic resin while its sealing ring can be composed of a comparatively harder synthetic resin. The ball can be composed of a synthetic resin or elastomeric moisture capable of resisting wear while the sealing ring is composed of polytetrafluoroethylene.

The ball of the cock remote from the opening, serving to maintain the vacuum, may be a steel ball with a polished surface and can cooperate with a soft elastic sealing ring. The housing in the region of this latter ball cock can be provided with a flange or fitting in connection to the means for supplying the product or withdrawing it in accordance with another feature of the invention.

The actuator for the ball can be provided with a venting device if desired. Furthermore, the throughgoing bore of the ball cock closest to the inlet and outlet opening can communicate in its closest position with a compartment in the housing communicating with a suction fitting.

The invention provides the significant advantage that it combines or integrates two elements, namely, the valve ball and the sieve plate such that the valve ball can protect the sieve plate against wear when the valve or ball cock is closed and the sieve plate can nevertheless function without the formation of dead spaces when the ball cock is open.

The second ball cock allows maintaining a vacuum in the passage in spite of the fact that the ball cock proximal to the inlet and outlet opening may be subjected to wear by impact of the milling bodies therewith. In spite of the fact, therefore, that this proximal ball cock may be distorted or worn by the impact with milling bodies thereon, the ability of the ball cock to mechanically block the escape of the milled product is usually not impeded although its loss of vacuum tightness does not pose a problem because of the presence of the second or distal ball cock.

The housing is connected by the flange joint utilizing a groove and sealing element received in the groove in a particularly effective manner and it is of particular advantage to the invention that the mechanical closure of the milling chamber and the maintenance of the vacuum can utilize ball cocks of different constructions.

Indeed, to the extent that there is a dead space between the two ball cocks because the proximal ball cock mechanically blocks escape of the milled product, only the finest milled product can penetrate past this ball cock into the dead space. Hence when the product is discharged, it cannot be contaminated with unmilled product.

Indeed, the space between the ball cocks cannot truly be considered a dead zone because uncontrolled presence of product in this region is precluded. Furthermore, the length of this dead zone is minimized since there is no need for a calming tube or the like as in earlier systems.

The venting device for the ball cock in the closed position thereof enables contaminants which may be present to be vented or extracted under suction.

While the invention has been described in connection with the discontinuous milling utilizing milling bodies, it is not limited thereto and the principles can be used for filters or sieves, especially when these must be operated under inert gas or under vacuum.

BRIEF DESCRIPTION OF THE DRAWING

The above and other objects, features, and advantages will become more readily apparent from the following description, reference being made to the accompanying drawing in which:

FIG. 1*b* is a section of the attritor of FIG. 1*a* with a fitting having a ball cock in which a sieve plate is integrated and is used in accordance with the invention;

FIG. 1*c* is a cross section through the ball cock of the fitting of FIG. 1*b*.

FIG. 1*d* is a cross section through a ball cock which can be fitted to the opening of the mill in FIG. 1*b;*

SPECIFIC DESCRIPTION

Figure 1A:
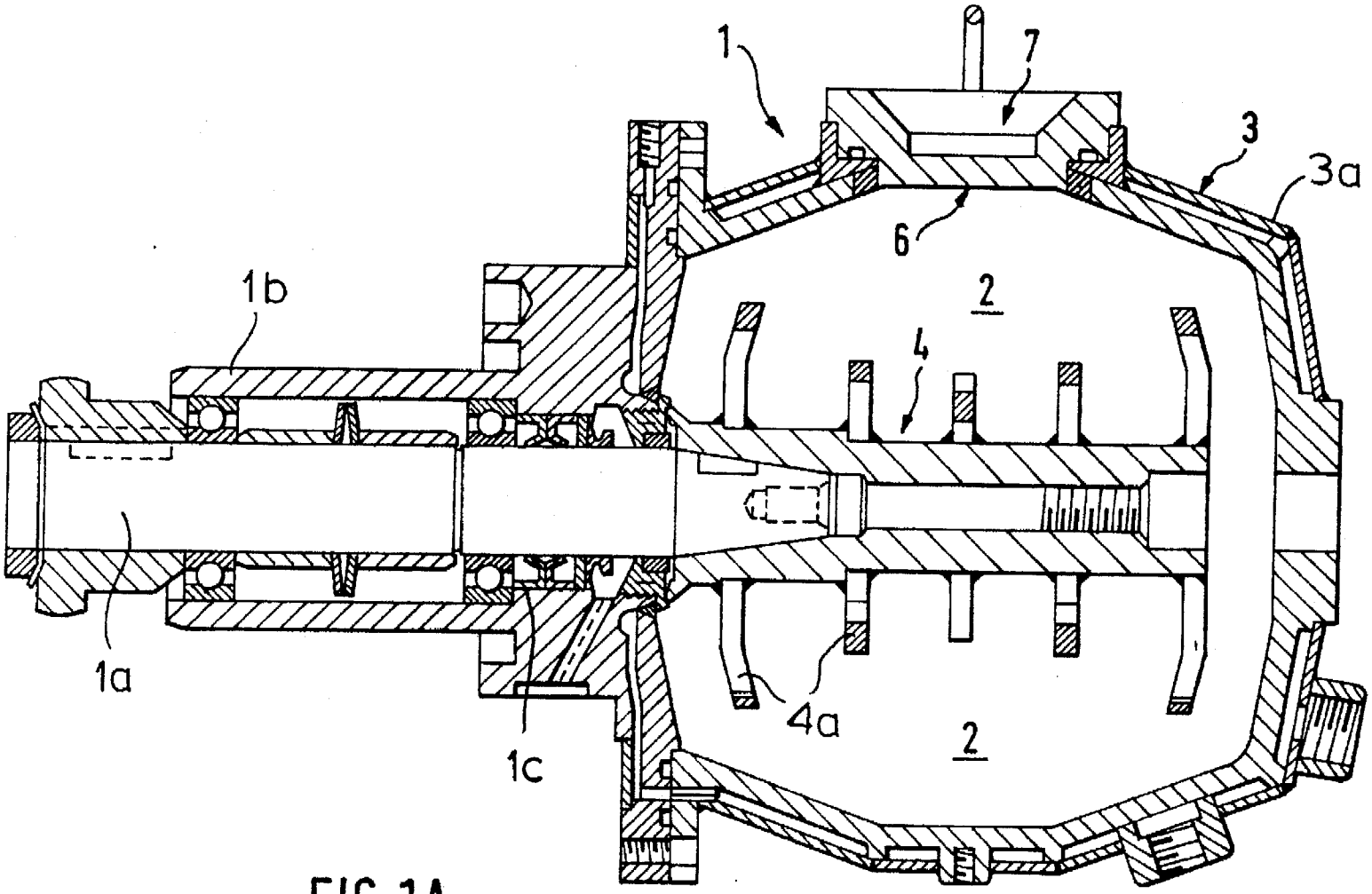
FIG. 1A PRIOR ART
FIG. 1*a* is a section of a prior art attritor with an inlet and outlet opening closed by a cover.

FIG. 1*a* shows the basic milling apparatus to which the present invention can be applicable. The milling vessel 3 defines a milling chamber 2 which is filled with milling bodies seen at 5 in FIG. 3*a* but not illustrated in FIG. 1*a*.

A shaft la driven by an electric motor but not otherwise illustrated is journaled in a bearing 1*b* and sealed against the vessel 2 by gland seals 1*c*. The shaft carries within the vessel 3 a rotor 4 provided with arms 4*a* which agitate the milling bodies 5 and the milled product and throw the milling bodies and the milled product against the walls of the vessel. l The vessel 3 can be provided with a jacket 3*a* which can be heated or cooled and the vessel can be evacuated if desired.

The vessel is provided with an opening 6 which can be closed by a cover I7. The basic apparatus of FIG. 1*a* is generally referred to as an attritor and is described in DE-OS 43 07 083 for the finest milling of solids.

Figures 2A, 2B, 2C:
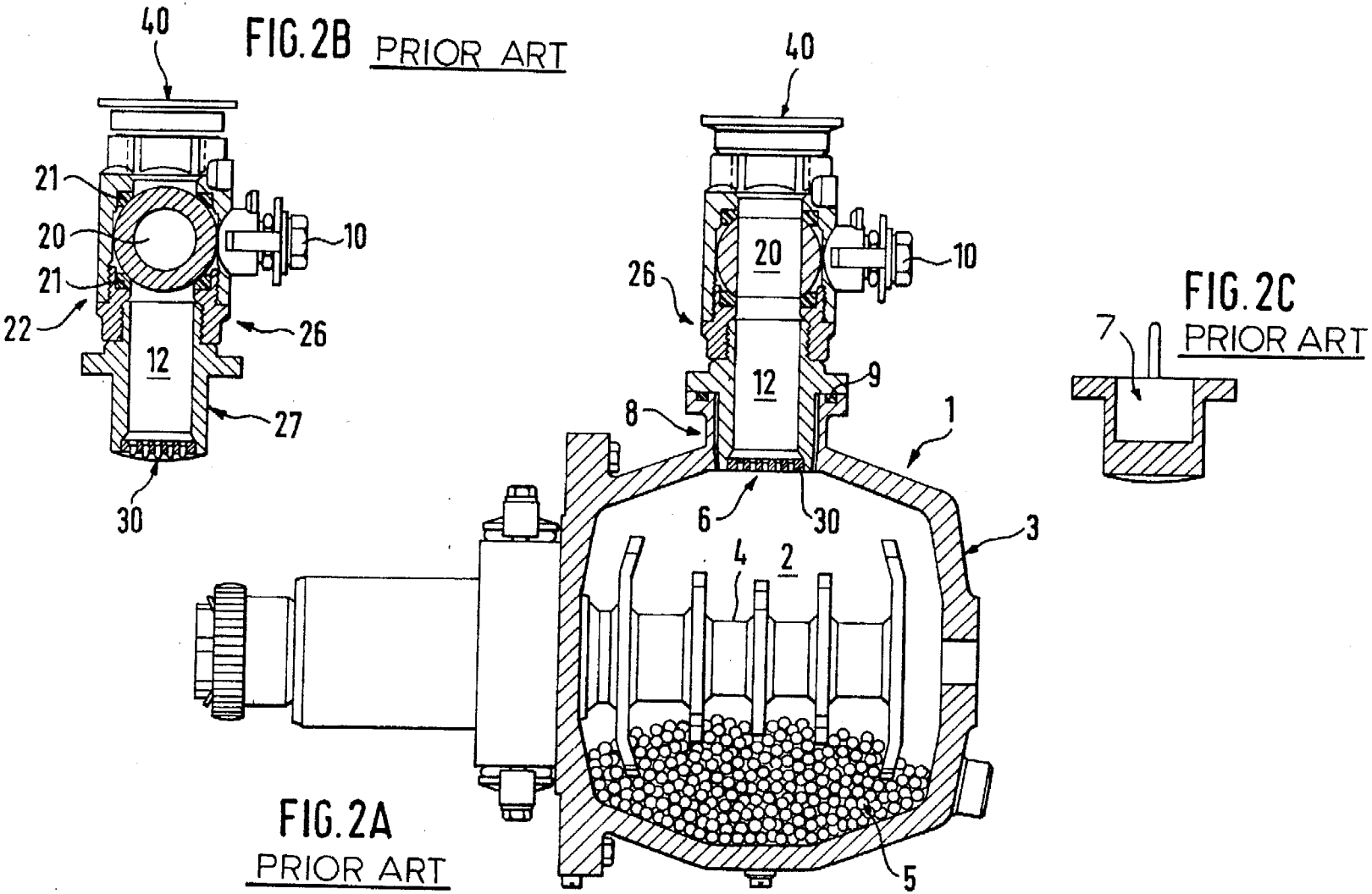
FIG. 2C PRIOR ART
FIG. 2B PRIOR ART
FIG. 2A PRIOR ART
FIG. 2*a* is a section of an attritor with a device for charging or emptying same in accordance with the prior art.
FIG. 2*b* is a section of the fitting of this prior art device itself.
FIG. 2*c* is a section of a closure or cover for the inlet and outlet opening in accordance with the prior art.

FIGS. 2*a*–2*c* show a milling unit similar to that of FIG. 1*a* and corresponding to the prior art, but with a charging and discharging apparatus. In this system, the cover 7 of FIG. 1*a* which has its inner surface flush with the wall of the vessel 3, provides a geometric optimum with respect to the flow conditions in the milling chamber 2. For filling and emptying the vessel 3 in the embodiment of FIG. 1 without the charging system of FIGS. 2*a*–2*c*, the cover 7 is removed and replaced by a sieve plate. This, of course, allows the ambient atmosphere access to the milled product and allows oxidation reactions to render the latter unuseful. A device 26 can thus be provided to permit charging and discharging of the mill as shown in FIGS. 2*a* and 2*b*.

In this case, a ball cock forms a valve 10, the ball cock having a valve ball 20 and housing 22. This ball cock is separated from the milling chamber 2 of the attritor 1 by an intervening passage forming piece 27 which sets back the valve 20 from the milling bodies 5 in the vessel 3. A sieve plate 30 is here located at the end of the pipe section 27 proximal to the opening 6. The result is a dead space between the sieve plate 30 and the valve ball 20. The dead space has been represented at 12 in FIGS. 2*a* and 2*b*. It will be apparent that, upon charging of the vessel 3, a portion of the product to be milled can remain in the dead space 12 and thus is not finally comminuted. When the valve 20 is opened to allow discharge of the product, e.g. by rotating the vessel 3 to allow gravity to discharge the finely divided powder, the milled product mixes the unmilled residue in the dead space 12 and is thereby contaminated.

It will be apparent from FIG. 2*b* that unit 26 is a self-contained unit which is mounted on the vessel 3 by a flange connection between the collar 8 thereof and a flange of the housing of the unit 26, a sealing ring 29 being received in a groove of this flange connection. FIG. 2*c* shows that a conventional cover may fit the collar 8 to close the mill when the unit 26 is removed.

FIGS. 1*b*–1*c* shows an embodiment of the present invention in which the charging or discharging of the mill is effected via a unit 25. The latter can comprise a housing 25*a* with annular seats 21 and 21*a* and a ball 20 actuated by a handle 10*a* of the valve 10. The ball 20 has a throughgoing bore 23 formed with a sieve plate 30 at an end of this bore proximal to the opening 6. The valve 10 is thus in the configuration of a ball cock whose valve ball 20 has a sieve plate 30 integrated therein.

FIG. 1*c* shows the valve in its closed state and not mounted on the vessel 3 of the mill. The closed state of the valve also provides optimum flow conditions in the interior of the milling vessel. FIG. 1*d* also shows the ball valve closed. The solid angle $\alpha$ in this case corresponds to the solid angle subtended by the valve plate 30.

The throughgoing opening 23 of the valve ball 20 is connected via a suction fitting 17 with a suction source. The fitting 17 communicates with the bore 23 via a passage 18 in the housing portion 22 of the valve. The suction can remove residual milled product or fluid medium by sucking the same out of the valve.

While the valve ball 20 provides an effective closure for the high kinetic energy particles within the mill, the surface of the ball exposed to these particles is subjected to considerable wear and deformation, especially by impingement of the mill bodies 5 thereagainst. The seal at the ring 21 can be, therefore, less than perfect. As a consequence, particles may escape. This does not, however, pose a significant problem of contamination, since these particles invariably will be the finest of the milled product and if they then are discharged with the contents of the mill will not contaminate it.

In FIGS. 3*a*, 3*b*, 4*a* and 4*b*, a further improvement in the system of the invention is shown. In this case, the device for charging and discharging an attritor with milling bodies operated discontinuously for the finest milling of solids has two axially-spaced valves 10 and 12 with a space 12 between them. The valves 10 and 11 are ball cocks 20*a* and 20*b* and have their housings 22 connected together into a common housing which, in turn, is connected to the opening 9 of the vessel 3. The first ball cock 20*a* proximal to the opening 6 has a sieve plate 30 integrated with its valve ball 20 and disposed in the throughgoing bore 23. The sieve plate 30, as has been indicated, has approximately the same solid angle as the blocking area of the valve ball 20, i.e. the same radian as the blocking surface.

Figures 3A, 3B, 3C, 3D:
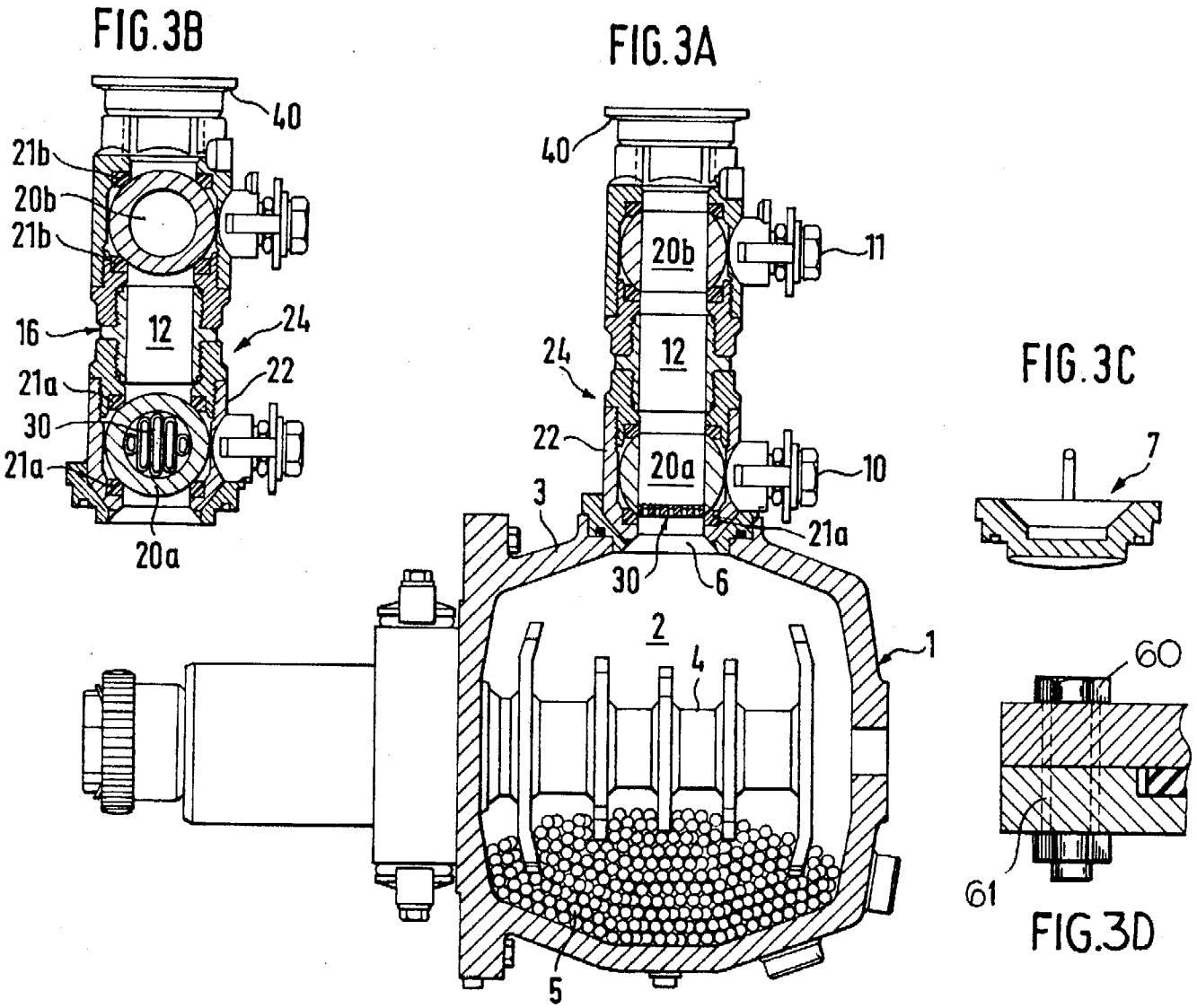
FIG. 3*a* is a section for an attritor having a two-cock device for charging and discharging a mill according to the invention.
FIG. 3*b* is a section through the charging device separate from the mill.
FIG. 3*c* is a section of another conventional vessel cover.
FIG. 3*d* is a detail section of a modification of FIG. 3*a;*

In FIG. 3*a*, the open positions of the ball cocks 20*a*, 20*b* have been illustrated. The mill powder can be discharged by rotating the vessel 3 about the axis thereof until the charging device is turned downwardly, whereupon the powder is emptied by gravity and passes the slits of the sieve plate 30 while the sieve plate holds back the milling bodies 5. In the closed positions of the valves (FIG. 3*b*), the blocking area of the valve ball is subjected to the impacts of the milling bodies 5 and the first ball cock can be distorted. This does not, however, pose a problem because the ball cock closest to the vessel 3 serves only to prevent the escape of dust while the second valve 20*b* serves to maintain the vacuum.

Figure 4B:
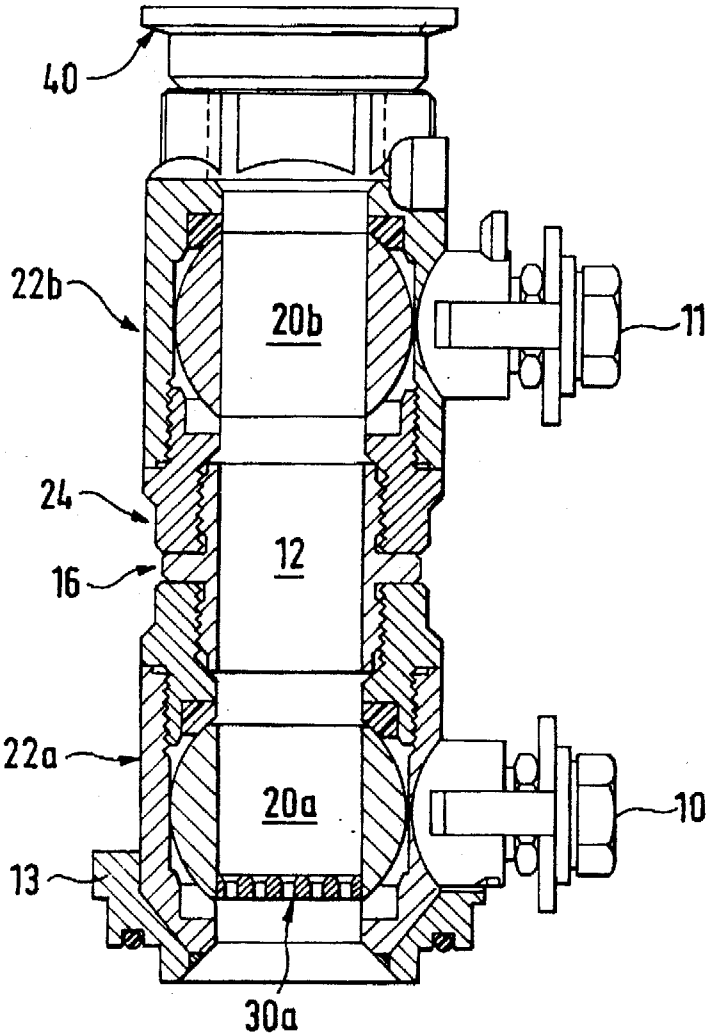
FIG. 4*b* is a section with the ball cocks open to the scale of FIG. 4*a*.
Figure 4A:
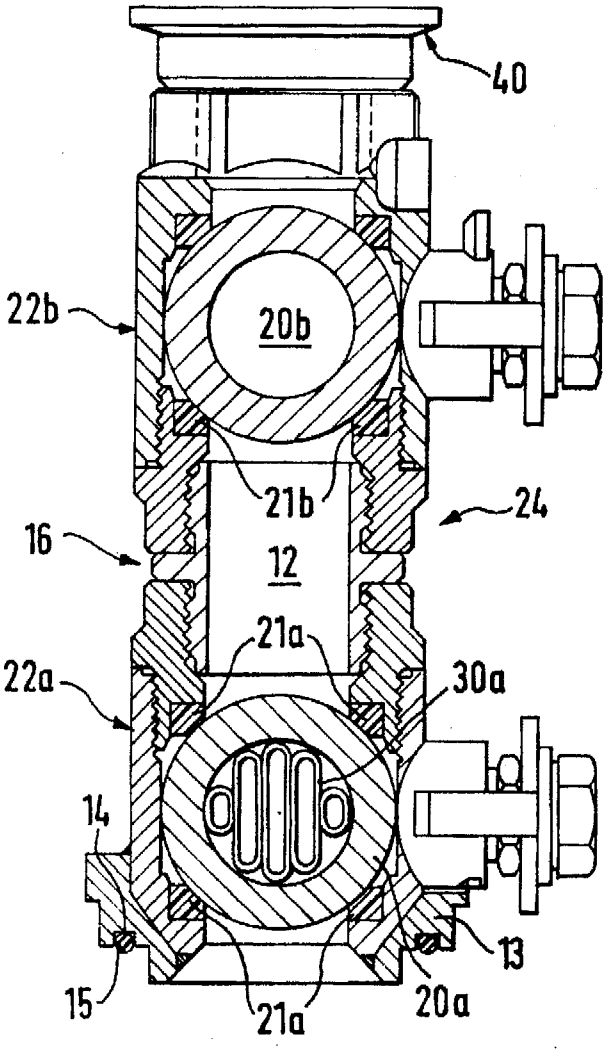
FIG. 4*a* is a section of the device of FIG. 3*a* with the ball cocks closed and drawn to a larger scale.

The unit 24 can be mounted on the opening 6 by a flange connection 13 formed with a groove 14 receiving the sealing element (FIG. 4*a*). The flange connection can have bolts 60 passing through bores 61 as represented in the embodiment illustrated in FIG. 3*d*, in the region of the opening 6 of the vessel 3.

In the two-cock system of the invention, the ball cock closest to the milling chamber serves only as a mechanical closure while the more distal ball cock 20*b* serves to maintain the vacuum. In this case, the ball cock 20*a* can loosely engage the sealing ring 21*a* against which its ball is seated.

The wear on the sealing ring 21*a* is thus significantly reduced in spite of the fact that the surface of the ball 20 may be damaged by contact with the milling bodies. During the milling operation the second valve cock is not subjected to wear and thus can maintain the vacuum tightness without a problem. Advantageously, the valve ball 20 of the ball cock 20*a* is composed of a comparatively soft elastic and preferably ductile elastic synthetic resin while the ring 21*a* is composed of a harder plastic. For example, the ball 20 can be composed of a wear-resistant elastomer while the ring 21*a* is composed of polytetrafluoroethylene. The ball of cock 20*b* can be composed of steel and can have a polished surface while its sealing ring 21*b* can be composed of a soft elastic material. A flange 40 is provided on the housing to enable connection to a duct supplying or receiving the product to be milled and the milled product.

FIGS. 4*a* and 4*b* show the ball cocks 20*a* and 20*b* in closed and open positions, respectively, and parts which are identical to those of FIGS. 3*a* and 3*b* have the same reference numerals. The ball cocks have respective housings 22*a* and 22*b* and these can be connected by a double sleeve 16. The housing 22*a* has a connection flange 13 and this flange can have a square groove 14 in which a sealing ring such as an O-ring is received. The flange 13 can be square in its plan view and can have bores at its corner to receive bolts in the manner previously described. The use of the system of FIGS. 4*a* and 4*b* is similar to that already described. The invention is, of course, applicable to other types of mills such as drum mills or oscillatory or hammer mills and the filling and emptying system can be used for filters and sieve systems. It is especially effective where a product must be maintained, filled and emptied under vacuum or in synthetic atmospheres.

It does not materially increase the cost of the apparatus since the additional ball cock or the provision of the sieve in the ball cock does not materially increase the cost over a system as shown in FIGS. 2*a* and 2*b*.

I claim:

1. A milling apparatus comprising:

a milling vessel formed with an opening for charging and discharging said vessel;

means in said vessel for agitating milling bodies in contact with a product to be milled for finely comminuting said product; and a device for charging and emptying said vessel, said device comprising:

a housing formed with a passage communicating with said opening, means for fluid-tight sealing of said housing to said vessel around said opening, and a first ball cock in said passage for controlling flow through said passage, said ball cock having a rotatable first ball formed with a throughgoing bore and with at least one sieve plate in said bore disposed at an end thereof closest to said opening upon rotation of said first ball to align said bore with said opening, said sieve plate being dimensioned to pass said product and retain said milling bodies in said vessel.

2. The milling apparatus defined in claim 1 wherein, upon rotation of said first ball to block said passage, said first ball presents a blocking surface to said opening, said sieve plate intercepting a solid angle of said first ball, said blocking surface intercepting substantially said solid angle of said ball.

3. The milling apparatus defined in claim 1, further comprising a second ball cock along said passage in said housing, the first ball cock being constructed and arranged to limit escape of dust from said vessel, said second ball cock being constructed and arranged to provide a vacuum-tight seal for said passage.

4. The milling apparatus defined in claim 1 wherein said means for fluid-tight sealing of said housing to said vessel comprises a flange connection between said housing and said vessel, at least one groove formed in a flange of said connection and a sealing element received in said one groove.

5. The milling apparatus defined in claim 1 wherein said means for fluid-tight sealing of said housing to said vessel comprises a flange connection between said housing and said vessel, and bolts passing through bores of flanges of said connection to hold said flanges together in a region of said opening.

6. The milling apparatus defined in claim 3 wherein said first and second ball cocks are of different constructions.

7. The milling apparatus defined in claim 6 wherein said ball of said first ball cock has sealing seats, one of said sealing seats being provided on a side of said ball proximal to said vessel, said one of said seats loosely engaging said ball.

8. The milling apparatus defined in claim 6 wherein a ball of said first ball cock and respective sealing seats thereof are composed of different material from a ball of said second ball cock and respective seats thereof.

9. The milling apparatus defined in claim 8 wherein said ball of said first ball cock is composed of a relatively soft elastic material and the respective seats are composed of a relatively hard synthetic resin.

10. The milling apparatus defined in claim 9 wherein said ball of said first ball cock is composed of an elastomer and the respective seats are composed of polytetrafluoroethylene.

11. The milling apparatus defined in claim 8 wherein the ball of said second ball cock is a steel ball with a polished surface and said sealing seats of said second ball cock are soft elastic.

12. The milling apparatus as defined in claim 6 wherein said housing has a flange adjacent said second ball cock for connection to a duct for filling or emptying the vessel.

13. The milling apparatus defined in claim 3, further comprising a venting device for at least one of said first and second ball cocks.

14. The milling apparatus defined in claim 1 wherein said housing has a recess communicating with a suction fitting and communicating with said bore in a closed position of the rotatable ball.

* * * * *